US010274280B2

(12) United States Patent
Chu et al.

(10) Patent No.: US 10,274,280 B2
(45) Date of Patent: Apr. 30, 2019

(54) TRIGGER LABOR-SAVING STRUCTURE OF CROSSBOW

(71) Applicant: MAN KUNG Enterprise Co., Ltd., Taichung (TW)

(72) Inventors: Fu-Hui Chu, Taichung (TW); Ching-Chi Hung, Taichung (TW)

(73) Assignee: Man Kung Enterprise Co., Ltd., Taichung (TW)

( * ) Notice: Subject to any disclaimer, the term of this patent is extended or adjusted under 35 U.S.C. 154(b) by 0 days.

(21) Appl. No.: 15/890,392

(22) Filed: Feb. 7, 2018

(65) Prior Publication Data

US 2018/0259288 A1 Sep. 13, 2018

(30) Foreign Application Priority Data

Mar. 8, 2017 (TW) ..... 106203346 U

(51) Int. Cl.
*F41B 5/12* (2006.01)
*F41A 17/56* (2006.01)
*F41A 19/06* (2006.01)

(52) U.S. Cl.
CPC ..... *F41B 5/12* (2013.01); *F41A 17/56* (2013.01); *F41A 19/06* (2013.01); *F41B 5/123* (2013.01)

(58) Field of Classification Search
CPC ..... F41B 5/12
See application file for complete search history.

(56) References Cited

U.S. PATENT DOCUMENTS 3,490,429 A * 1/1970 Benedict ..... F41B 7/046 124/25
4,877,008 A * 10/1989 Troubridge ..... F41B 5/1469 124/25
8,522,761 B1 * 9/2013 Chu ..... F41A 19/10 124/25
2009/0194086 A1 * 8/2009 Kempf ..... F41A 19/10 124/25
2014/0246003 A1 * 9/2014 Lipowski ..... F41A 17/46 124/25

* cited by examiner

*Primary Examiner* — John Ricci
(74) *Attorney, Agent, or Firm* — Alan D. Kamrath; Kamrath IP Lawfirm, P.A.

(57) ABSTRACT

In a trigger labor-saving structure of a crossbow, the crossbow includes a body, an arcuate limb, and a trigger assembly. The limb is mounted adjacent to a front end of the body and intersects with the body, and the limb includes a bowstring. The trigger assembly includes: a trigger seat arranged on the body, a trigger partially accommodated in the trigger seat and downward extending out of the trigger seat, with the trigger having a stop face, and with the stop face having a first periphery and a second periphery; a string hook member housed in the trigger seat and including an engagement face corresponding to the stop face; and at least one concave portion formed on the stop face and defined between the first periphery and the second periphery. Thus, frictional resistance between the stop face and the engagement face reduces.

2 Claims, 9 Drawing Sheets

TRIGGER LABOR-SAVING STRUCTURE OF CROSSBOW

BACKGROUND OF THE INVENTION

Field of the Invention

The present invention relates to a crossbow and, more particularly, to a trigger labor-saving structure of the crossbow.

Description of the Prior Art

A conventional crossbow contains a body and a limb. The body has a crossbow stock formed on a rear end thereof, a trigger arranged on a front end of the crossbow stock, a connection mount connected on the trigger, and a sight telescope fixed on the connection mount. The limb is in an arc shape and is mounted adjacent to a front end of the body. The limb intersects with the body, so that the body and the limb are formed in a cross shape. In operation, a bowstring is pulled backward to hook on the trigger, an arrow is placed on the body to correspond to the bowstring, and a target is aimed by using the sight telescope. Thereafter, the trigger is pressed, so that the bowstring removes from the trigger, and so that the arrow is pushed to shoot outwardly.

A conventional trigger assembly contains a trigger and a string hook member. The trigger has a stop face defined on an end thereof, and the string hook member has an engagement face formed on an end thereof and corresponding to the stop face. When the bowstring is pulled rearward to be hooked by the string hook member, the engagement face of the string hook member is stopped by the stop face of the trigger. While pulling the trigger, the stop face of the trigger removes from the engagement face of the string hook member, so that the bowstring removes from the string hook member, and so that an arrow is pushed by the bowstring to shoot outwardly.

However, the stop face of the trigger and the engagement face of the string hook member are plane to produce friction resistance between the stop face and the engagement face greatly, thus pulling the trigger troublesomely as triggering the trigger.

The present invention has arisen to mitigate and/or obviate the afore-described disadvantages.

SUMMARY OF THE INVENTION

The primary objective of the present invention is to provide a trigger labor-saving structure of a crossbow in which at least one concave portion is formed on a stop face of a trigger. The at least one concave portion is defined between a first periphery and a second periphery of the stop face. Thus, frictional resistance between the stop face and an engagement face reduces without influencing structural strength of the trigger, to save operation labor of the trigger, when triggering the crossbow.

To obtain the above-mentioned objective, in a trigger labor-saving structure of a crossbow provided by the present invention, the crossbow contains: a body, a limb, and a trigger assembly.

The limb is in an arc shape and is mounted adjacent to a front end of the body, and the limb intersects with the body and includes a bowstring fixed on two ends of the limb. The trigger assembly includes:

a trigger seat arranged on the body of the crossbow;

a trigger partially accommodated in the trigger seat and downward extending out of the trigger seat to control triggering of the crossbow, with the trigger having a stop face defined on an end of the trigger inside the trigger seat, and with the stop face having a first periphery and a second periphery opposite to the first periphery;

a string hook member housed in the trigger seat to hook the bowstring of the crossbow after the bowstring is pulled rearward with the string hook member including an engagement face formed on an end of the string hook member corresponding to the stop face of the trigger; and at least one concave portion formed on the stop face of the trigger and defined between the first periphery and the second periphery of the stop face, such that frictional resistance between the stop face and the engagement face reduces without influencing structural strength of the trigger.

DETAILED DESCRIPTION OF THE PREFERRED EMBODIMENTS

Figure 1:
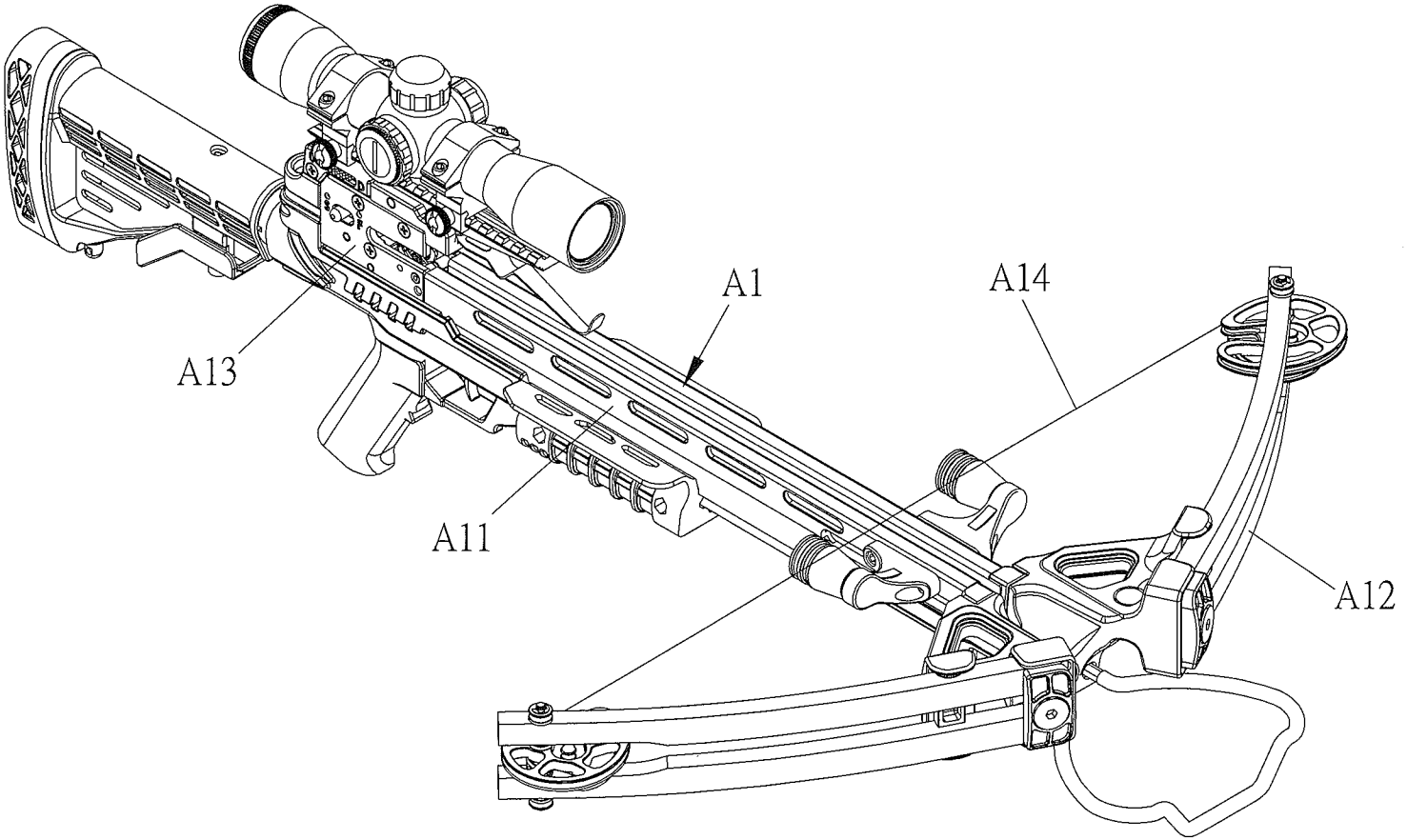
FIG. 1 is a perspective view showing the assembly of a trigger labor-saving structure of a crossbow according to a first embodiment of the present invention.
Figure 2:
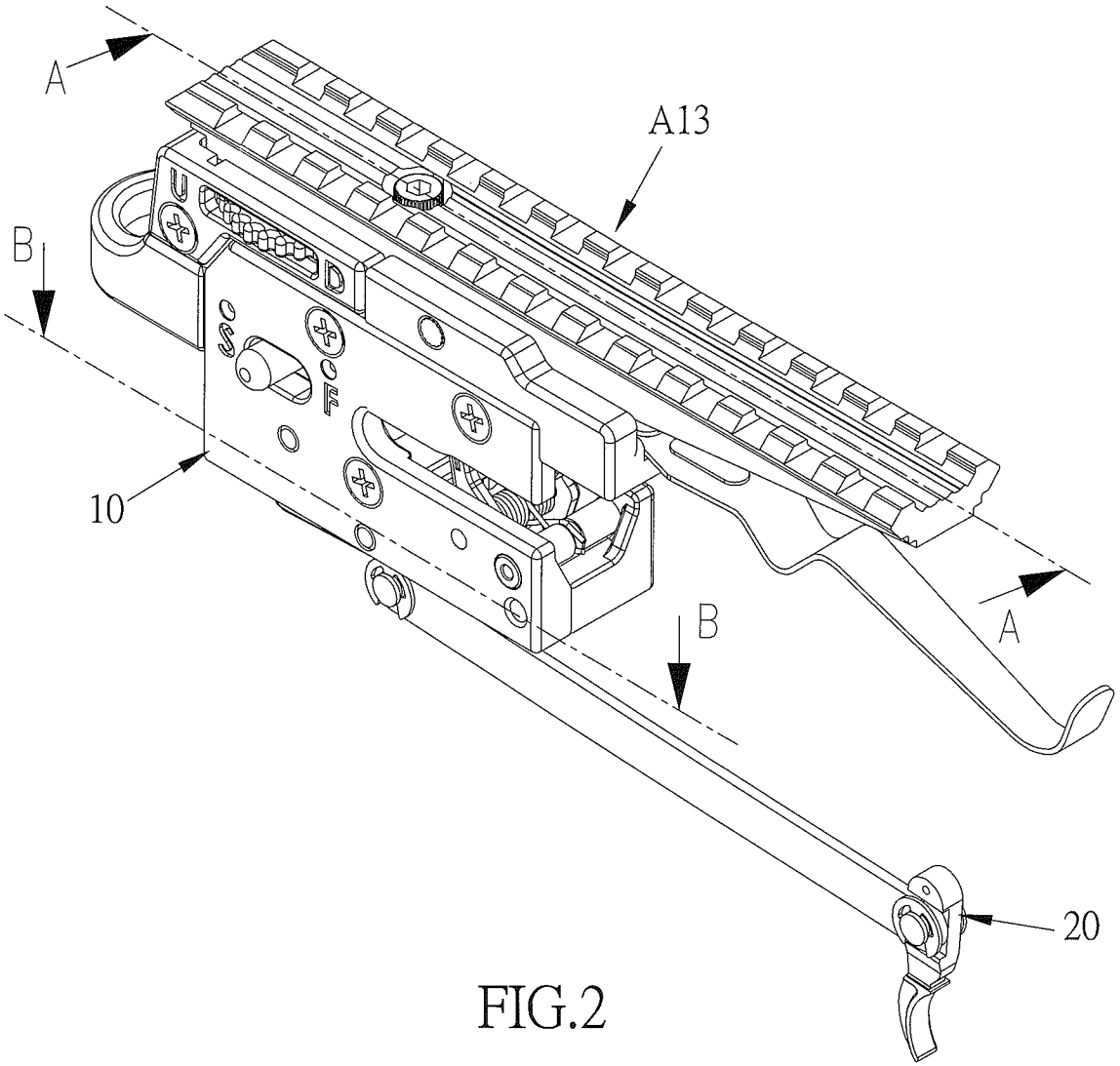
FIG. 2 is a perspective view showing the assembly of a trigger assembly of the trigger labor-saving structure of the crossbow according to the first embodiment of the present invention.
Figure 3:
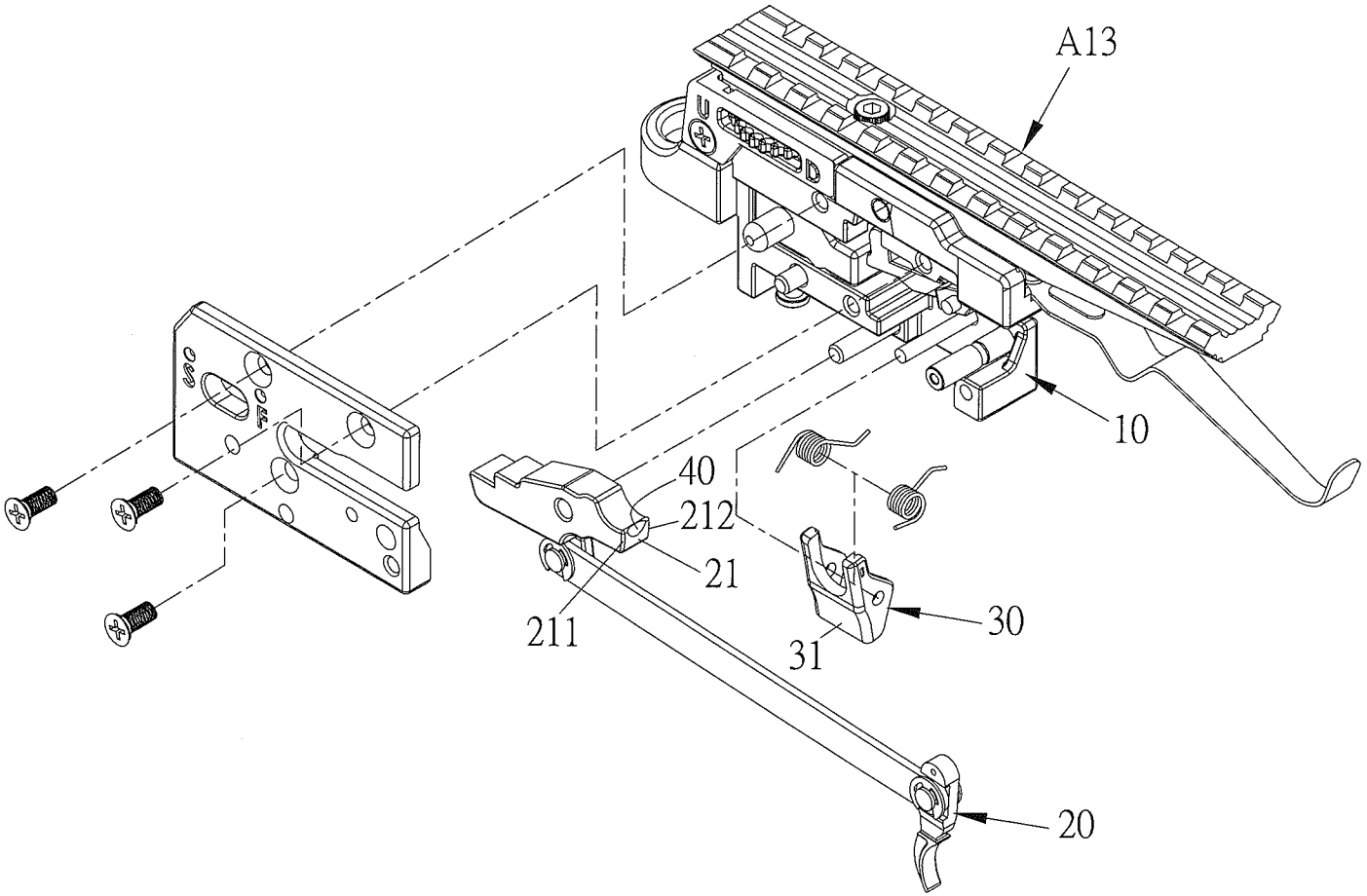
FIG. 3 is a perspective view showing the exploded components of the trigger assembly of the trigger labor-saving structure of the crossbow according to the first embodiment of the present invention.
Figure 4:
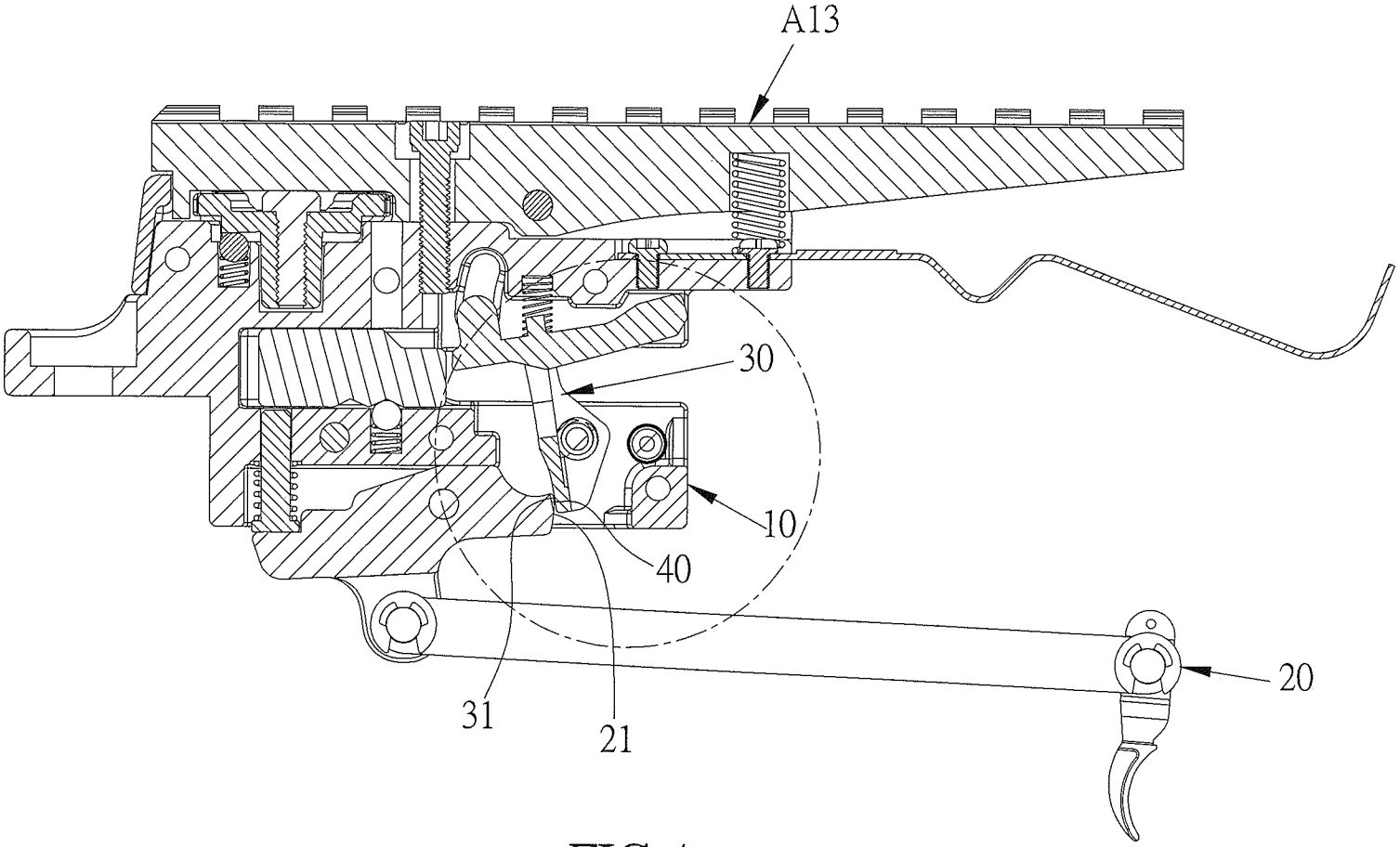
FIG. 4 is a cross sectional view taken along the line A-A of FIG. 2.
Figure 4A:
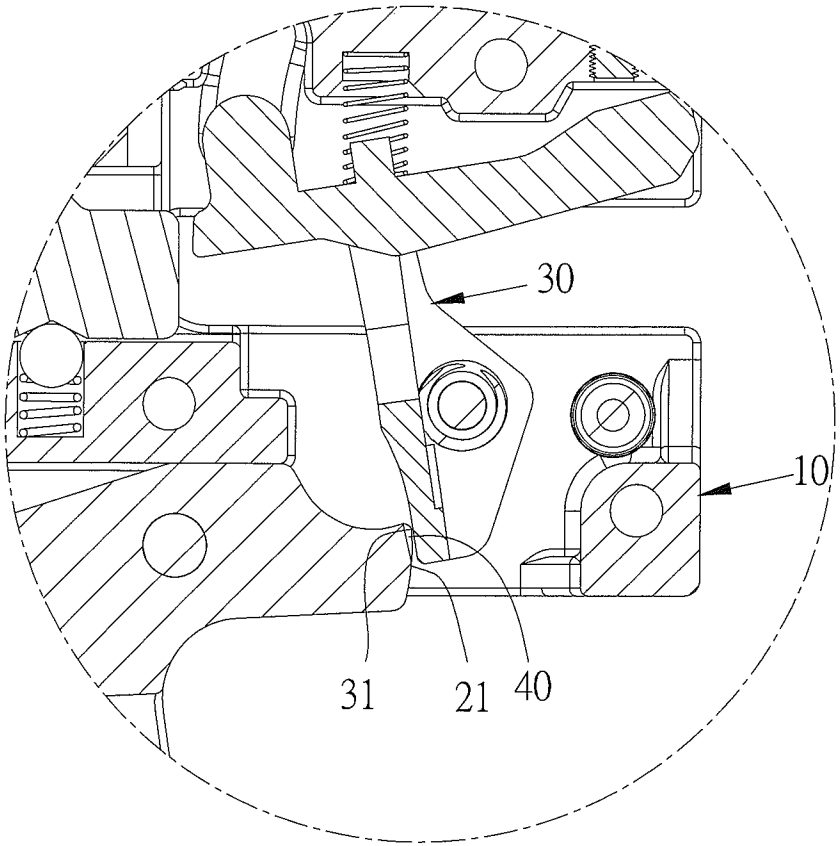
FIG. 4A is an amplified cross sectional view of a portion circled by a dotted line of FIG. 4.
Figure 5:
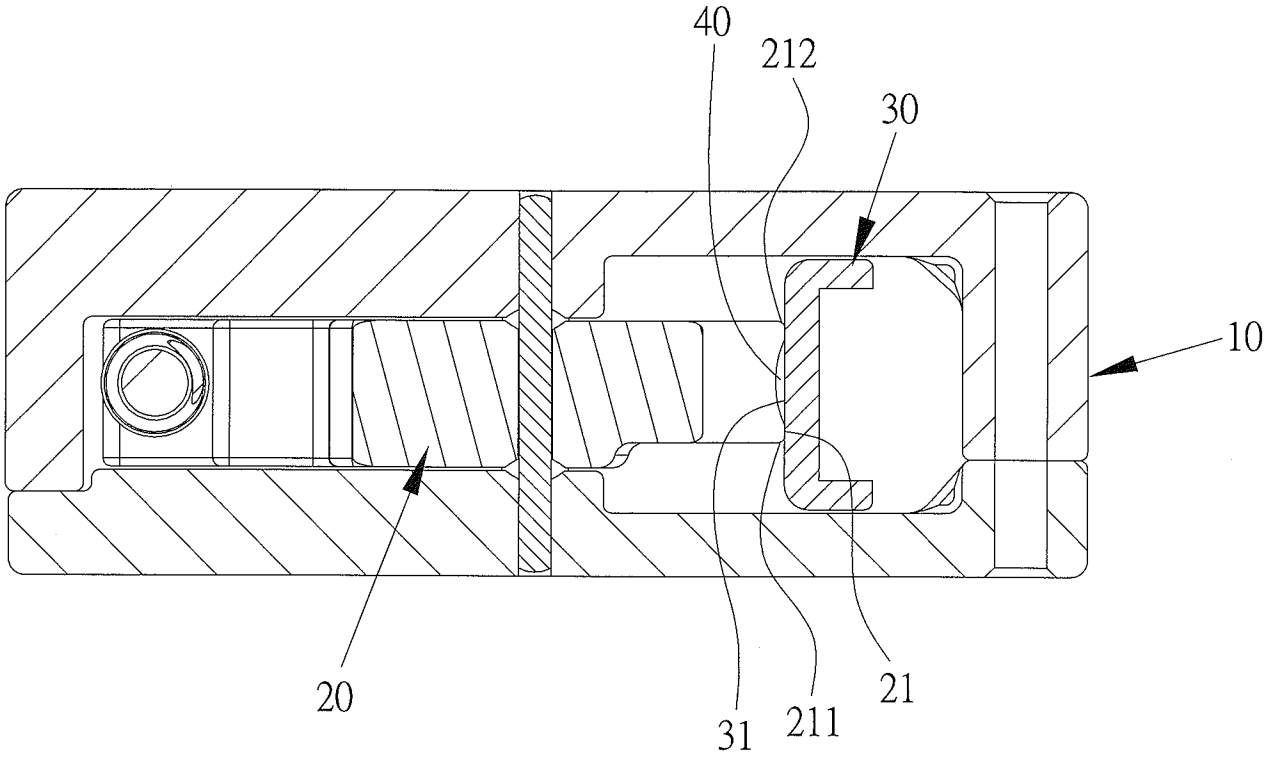
FIG. 5 is a cross sectional view taken along the line B-B of FIG. 2.

The present invention will be clearer from the following description when viewed together with the accompanying drawings, which show, for purpose of illustration only, preferred embodiments in accordance with the present invention.

With reference to FIGS. 1-5, in a trigger labor-saving structure of a crossbow in accordance with a first embodiment of the present invention, the crossbow Al includes a body A11, a limb A12, and a trigger assembly A13. The limb A12 is in an arc shape and is mounted adjacent to a front end of the body A11. The limb A12 intersects with the body A11 so that the body A11 and the limb A12 are formed in a cross shape. The limb A12 includes a bowstring A14 fixed on two ends thereof. The trigger assembly A13 includes a trigger seat 10, a trigger 20, a string hook member 30, and at least one concave portion 40.

The trigger seat 10 is arranged on the body A11 of the crossbow A1.

The trigger 20 is partially accommodated in the trigger seat 10 and downward extending out of the trigger seat 10 to control triggering of the crossbow A1. The trigger 20 has a stop face 21 defined on an end thereof inside the trigger seat 10, and the stop face 21 has a first periphery 211 and a second periphery 212 opposite to the first periphery 211.

The string hook member 30 is housed in the trigger seat 10 to hook the bowstring A14 of the crossbow A1 after the bowstring A14 is pulled rearward. The string hook member 30 includes an engagement face 31 formed on an end thereof corresponding to the stop face 21 of the trigger 20.

In this embodiment, a concave portion 40 is arcuate and is formed on the stop face 21 of the trigger 20. The concave portion 40 is defined between the first periphery 211 and the second periphery 212 of the stop face 21.

Figure 6:
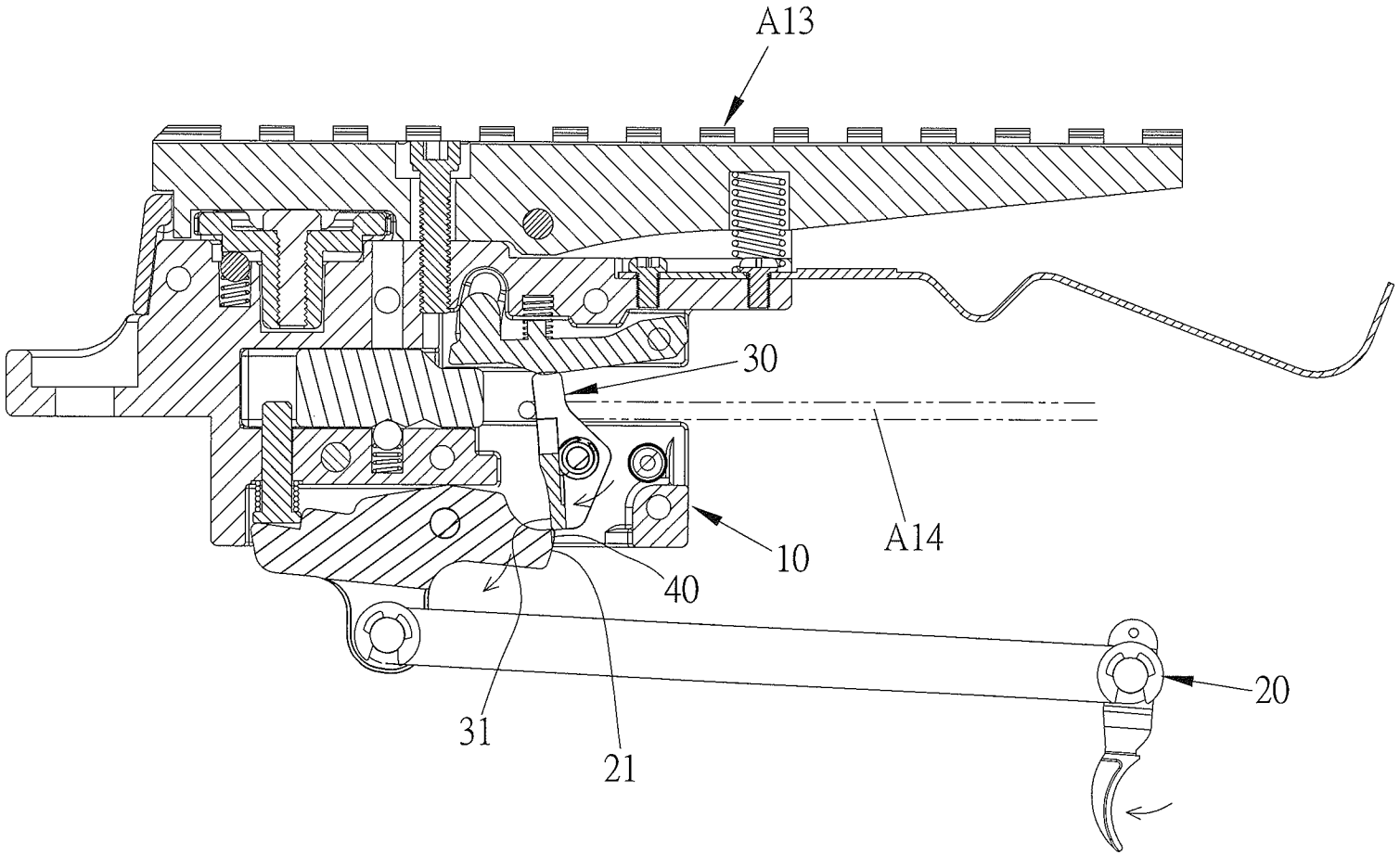
FIG. 6 is a cross sectional view showing the operation of the trigger labor-saving structure of the crossbow according to the first embodiment of the present invention.

As shown in FIG. 6, when triggering the crossbow, the bowstring A14 is pulled rearward to be hooked on the string hook member 30. In the meantime, the engagement face 31 of the string hook member 30 is stopped by the stop face 21 of the trigger 20. When triggering the crossbow by using the trigger 20, the stop face 21 of the trigger 20 removes from the engagement face 31 of the string hook member 30, so that the bowstring A14 removes from the string hook member 30, and so that an arrow is pushed by the bowstring A14 to shoot outwardly.

Figure 7:
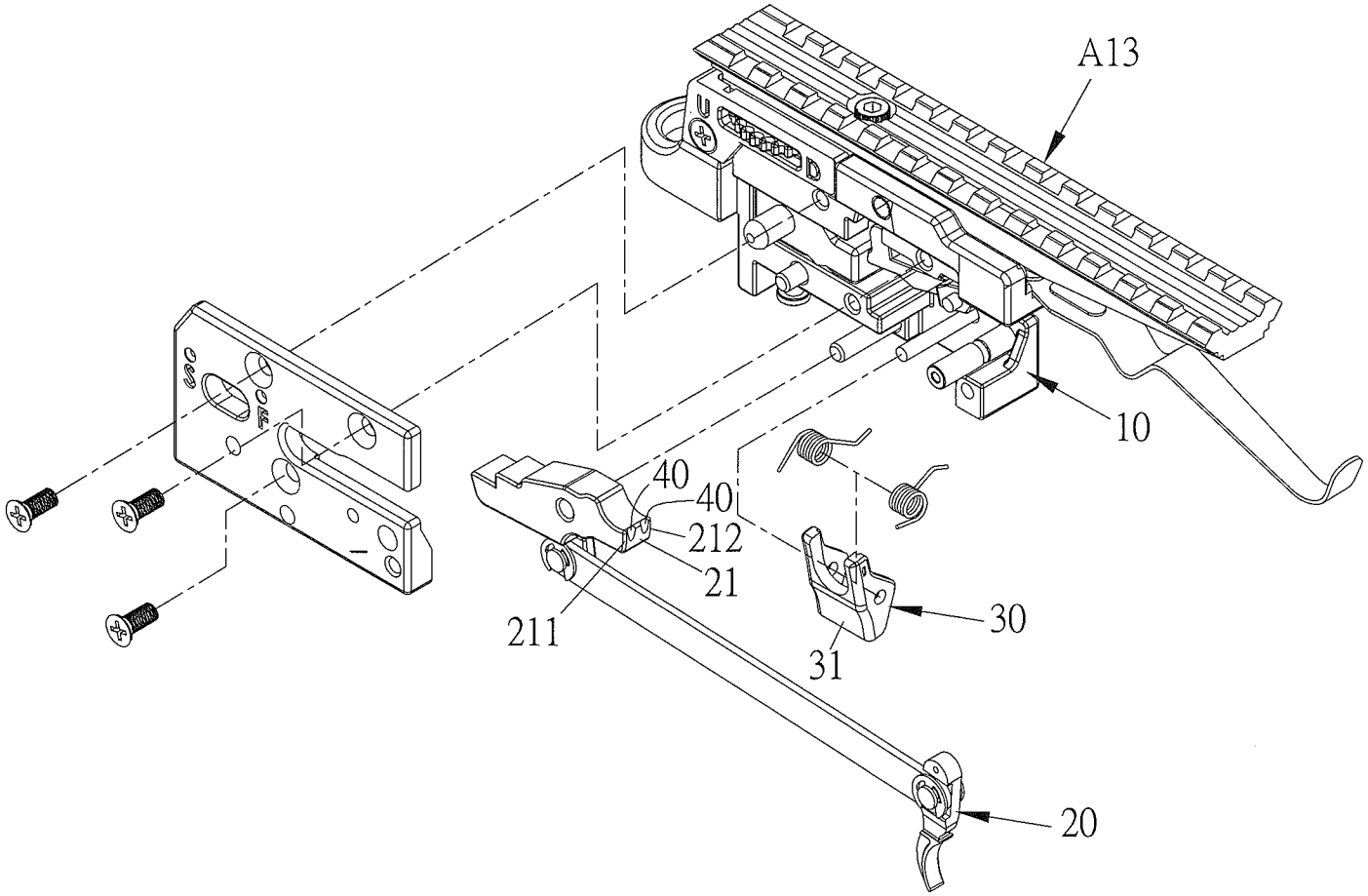
FIG. 7 is a perspective view showing the exploded components of a trigger assembly of a trigger labor-saving structure of a crossbow according to a second embodiment of the present invention.
Figure 8:
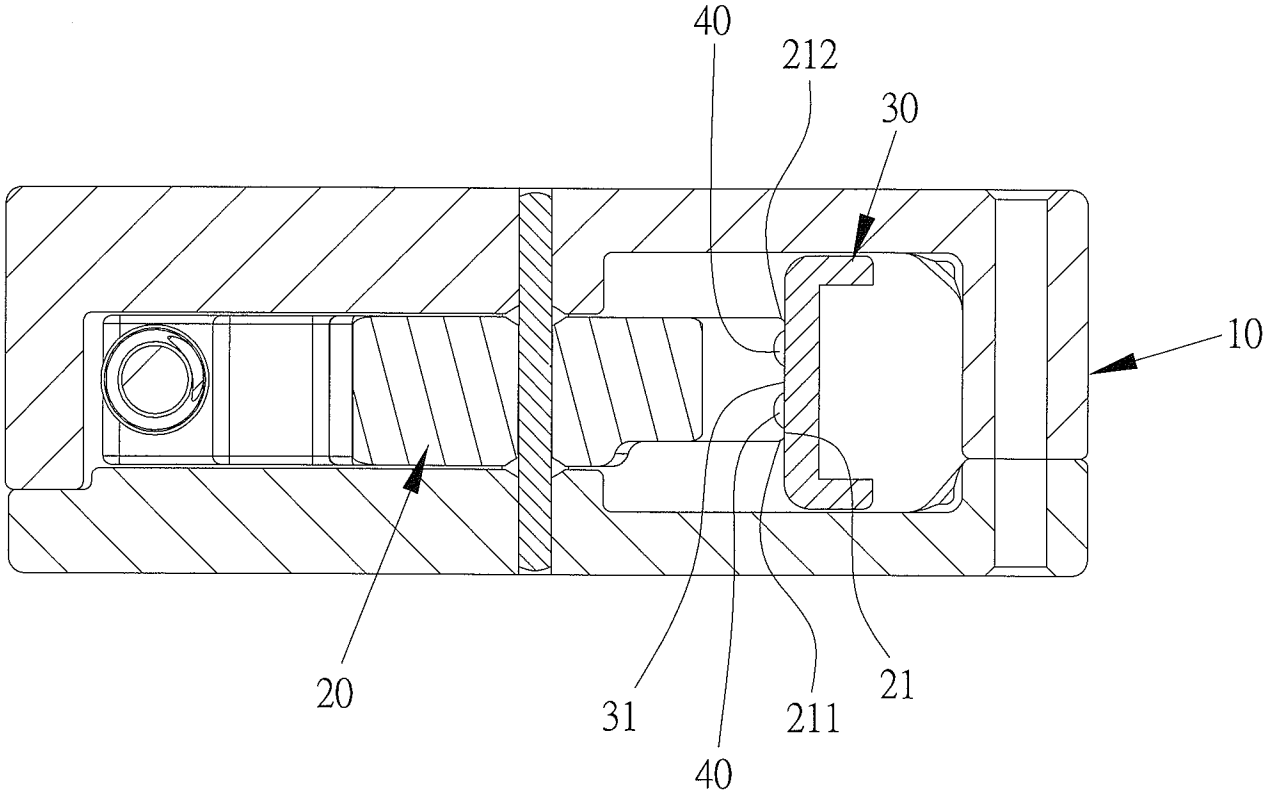
FIG. 8 is a cross sectional view showing the assembly of the trigger assembly of the trigger labor-saving structure of the crossbow according to the second embodiment of the present invention.

Referring to FIGS. 7 and 8, a difference of a trigger labor-saving structure of a crossbow from that of the first embodiment comprises: the trigger assembly A13 having two concave portions 40 which are defined on the stop face 21 of the trigger 20 and between the first periphery 211 and the second periphery 212 of the stop face 21.

Thereby, the trigger labor-saving structure of the present invention has advantages as follows:

the at least one concave portion 40 is formed on the stop face 21 of the trigger 20, and the concave portion 40 is defined between the first periphery 211 and the second periphery 212 of the stop face 21. Thus, frictional resistance between the stop face 21 and the engagement face 31 reduces without influencing structural strength of the trigger 20, to save operation labor of the trigger 20, when triggering the crossbow.

While various embodiments in accordance with the present invention have been shown and described, it is clear to those skilled in the art that further embodiments may be made without departing from the scope of the present invention.

What is claimed is:

1. A trigger labor-saving structure of a crossbow, with the crossbow including: a body, a limb, and a trigger assembly, with the limb being in an arc shape and being mounted adjacent to a front end of the body, and with the limb intersecting with the body and including a bowstring fixed on two ends of the limb, wherein the trigger assembly includes:

a trigger seat arranged on the body of the crossbow;

a trigger partially accommodated in the trigger seat and downward extending out of the trigger seat to control triggering of the crossbow, with the trigger having a stop face defined on an end of the trigger inside the trigger seat, and with the stop face having a first periphery and a second periphery opposite to the first periphery;

a string hook member housed in the trigger seat to hook the bowstring of the crossbow after the bowstring is pulled rearward, with the string hook member including an engagement face formed on an end of the string hook member corresponding to the stop face of the trigger; and at least one concave portion formed on the stop face of the trigger, defined between the first periphery and the second periphery of the stop face and of a size parallel to the first and second peripheries smaller than the first and second peripheries, with the first periphery of the stop face engaging the engagement face around the at least one concave portion, wherein frictional resistance between the stop face and the engagement face reduces without influencing structural strength of the trigger.

2. The trigger labor-saving structure as claimed in claim 1, wherein the at least one concave portion is arcuate.

* * * * *